US009159266B2

(12) United States Patent
Kim

(10) Patent No.: US 9,159,266 B2
(45) Date of Patent: Oct. 13, 2015

(54) PIXEL, DISPLAY DEVICE INCLUDING THE SAME, AND DRIVING METHOD THEREOF

(71) Applicant: Su-Weon Kim, Yongin (KR)

(72) Inventor: Su-Weon Kim, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 122 days.

(21) Appl. No.: 13/795,798

(22) Filed: Mar. 12, 2013

(65) Prior Publication Data

US 2014/0132583 A1 May 15, 2014

(30) Foreign Application Priority Data

Nov. 12, 2012 (KR) ..... 10-2012-0127507

(51) Int. Cl.
*G09G 3/32* (2006.01)

(52) U.S. Cl.
CPC ..... *G09G 3/3233* (2013.01); *G09G 2300/0852* (2013.01); *G09G 2300/0866* (2013.01)

(58) Field of Classification Search
None
See application file for complete search history.

(56) References Cited

U.S. PATENT DOCUMENTS

2006/0279501 A1* 12/2006 Lu et al. ..... 345/94
2011/0001711 A1* 1/2011 Choi et al. ..... 345/173
2011/0025671 A1* 2/2011 Lee ..... 345/211
2012/0007848 A1* 1/2012 Han et al. ..... 345/212
2012/0146936 A1* 6/2012 Liu ..... 345/174
2012/0249615 A1* 10/2012 Lee ..... 345/691

FOREIGN PATENT DOCUMENTS

KR 10-2011-0126364 A 11/2011
KR 10-2011-0136775 A 12/2011
KR 10-2012-0014717 A 2/2012
KR 10-2012-0044508 A 5/2012

* cited by examiner

*Primary Examiner* — Nicholas Lee
*Assistant Examiner* — Duane N Taylor, Jr.
(74) *Attorney, Agent, or Firm* — Lee & Morse, P.C.

(57) ABSTRACT

A pixel, a display device including the same, and a driving method thereof are provided. The display device includes: a display unit including pixels connected to corresponding scan lines and corresponding data lines; a scan driver sequentially generating and transmitting scan signals respectively corresponding to the pixels; a data driver generating and transmitting data voltages according to corresponding image data signals to a plurality of data lines during one frame; a first power source voltage driver respectively applying a first power source voltage to the pixels; a second power source voltage driver respectively applying a second power source voltage to the pixels; and a signal controller controlling the operation of the drivers, wherein a predetermined reference voltage is transmitted through data lines during a remaining period of one frame other than a period in which the data voltage is transmitted.

31 Claims, 6 Drawing Sheets

PIXEL, DISPLAY DEVICE INCLUDING THE SAME, AND DRIVING METHOD THEREOF

CROSS-REFERENCE TO RELATED APPLICATION

This application claims priority to and the benefit of Korean Patent Application No. 10-2012-0127507 filed in the Korean Intellectual Property Office on Nov. 12, 2012, the entire contents of which are incorporated herein by reference.

BACKGROUND

1. Field

Embodiments relate to a pixel, a display device including the same, and a driving method thereof.

2. Description of the Related Art

As display panels have become larger and lighter, a stable driving method has been developed in order to display an accurate and clear image with high-integration and high-precision in order to implement a 3D stereoscopic image.

In particular, a display device including a large-sized display panel or high-speed frame driving for driving of the 3D stereoscopic image is required. Since respective periods for initialization of a data voltage, compensation of a threshold voltage of a driving transistor, writing of data, and light emission are not sufficiently ensured by the high-speed driving mode, realization of images having accurate luminance.

In order to solve the problem, various research and development for a pixel circuit structure, a driving mode, and luminance compensation have been conducted. However, since the pixel circuit structure is complicated and power consumption may increase due to the luminance compensation or the driving mode, adverse effects including increased production costs and lack of improvement in non-uniformity of luminance may occur. Also, the driving method becomes complicated due to the complicated circuit structure and the signal connection wire, such that stable driving of the pixel is difficult and a reduction of the aperture ratio is caused.

Accordingly, a pixel and a display device including the same are required, that improves numerous aspects, such as simplification of pixel circuits and wiring, and a driving method thereof ensuring a sufficient period of each driving process and stable driving, while ensuring a pixel aperture ratio of a large scale display panel or a high resolution display panel and maintaining performance thereof.

The above information disclosed in this Background section is only for enhancement of understanding of the background and therefore it may contain information that does not form the prior art that is already known in this country to a person of ordinary skill in the art.

SUMMARY

A display device according to an exemplary embodiment includes: a display unit including a plurality of pixels connected to corresponding scan lines among a plurality of scan lines and corresponding data lines among a plurality of data lines; a scan driver sequentially generating and transmitting scan signals respectively corresponding to the pixels and a plurality of scan lines; a data driver generating and transmitting data voltages according to corresponding image data signals to a plurality of data lines during one frame; a first power source voltage driver respectively applying a first power source voltage to the pixels; a second power source voltage driver respectively applying a second power source voltage to the pixels; and a signal controller controlling the operation of the scan driver, the data driver, the first power source voltage driver, and the second power source voltage driver, wherein a predetermined reference voltage is transmitted through a plurality of data lines during a remaining period except for a period in which the data voltage is transmitted among one frame.

The voltage value of the predetermined reference voltage may be determined within a voltage range of the data voltage.

The voltage value of the predetermined reference voltage may be a middle value between a maximum voltage value and a minimum voltage value among the voltage range of the data voltage.

One frame includes a first period for initializing the data voltage according to the image data signal of a previous frame that is respectively written to the pixel, a second period for compensating a threshold voltage of the driving transistor of the pixel, a third period in which the corresponding scan signal is sequentially transmitted to the pixel and the data voltage according to the image data signal is transmitted, and a fourth period in which a plurality of pixels simultaneously emit light according to the driving current corresponding to the data voltage according to the image data signal respectively transmitted to the pixel, wherein the predetermined reference voltage is applied in the first period, the second period, and the fourth period.

The first power source voltage driver and the second power source voltage driver may apply the first power source voltage and the second power source voltage of predetermined voltage values with different levels from each other during the initialization period for initializing the data voltage according to the image data signal of the previous frame that is respectively written to the pixel among one frame and the light emitting period in which a plurality of pixels simultaneously emit the light according to the driving current corresponding to the data voltage according to the image data signal respectively transmitted to the pixel.

The first power source voltage driver may apply the first power source voltage with a voltage value that is lower than the voltage level of the second power source voltage during the initialization period for initializing the data voltage according to the image data signal of the previous frame that is respectively written to the pixel among one frame.

The first power source voltage may be determined as a voltage value of a level that is lower than a minimum voltage value among a voltage range of the data voltage.

The second power source voltage driver may apply the second power source voltage that is determined to have a voltage value that is lower than the voltage level of the first power source voltage or a ground potential during the light emitting period for simultaneously light-emitting according to the driving current corresponding to the data voltage of the image data signal that is respectively written to the pixel among one frame.

The second power source voltage may be determined and applied with a voltage value of a level that is higher than a maximum voltage value among a voltage range of the data voltage during the remaining period except for the light emitting period among one frame.

The first power source voltage and the second power source voltage may be simultaneously provided for a plurality of pixels included in the display unit.

The scan driver simultaneously applies the scan signal corresponding to each pixel to a plurality of scan lines during a predetermined period among one frame and simultaneously applies the corresponding scan signal for a plurality of scan lines during the remaining period except for the predetermined period.

The voltage level of the scan signal that is simultaneously applied for a plurality of scan lines may be a voltage level turning on a switch included in each pixel during a period for compensating a threshold voltage of a driving transistor included in each pixel among the remaining period except for the predetermined period.

A pixel according to an exemplary embodiment includes: an organic light emitting diode (OLED) displaying an image by emitting light according to a driving current corresponding to a data voltage according to an image data signal; a switching transistor transmitting the data voltage applied through the data line to a first node in response to a scan signal applied through a scan line; a first capacitor including one electrode connected to the first node and the other electrode connected to a second node; a second capacitor including one electrode connected to the second node and the other electrode connected to a first power source voltage supply source; a driving transistor including a gate electrode connected to the second node, a source electrode connected to the first power source voltage supply source, and a drain electrode connected to a third node and flowing a driving current corresponding to the data voltage to the organic light emitting diode (OLED); and a compensation transistor including a gate electrode connected to the scan line, a source electrode connected to the third node, and a drain electrode connected to the second node and diode-connecting the gate electrode and the drain electrode of the driving transistor in response to the scan signal applied through the scan line.

The pixel may further include a boost capacitor including one electrode connected to the second node and the other electrode connected to the scan line.

The boost capacitor may change the voltage value of the second node in response to the scan signal applied through the scan line.

A predetermined reference voltage may be applied through the data line during the remaining period except for a period in which the switching transistor transmits the data voltage according to the image data signal among one frame.

During an initialization period for initializing the data voltage according to an image data signal of a previous frame that is written to the pixel and a light emitting period in which the organic light emitting diode (OLED) emits light according to a driving current corresponding to the data voltage according to the image data signal transmitted to the pixel, the first power source voltage applied from the first power source voltage supply source and the second power source voltage applied to a cathode of the organic light emitting diode (OLED) may be determined to have voltage values of different levels from each other.

The first power source voltage may be determined to be a voltage value of a level that is lower than the second power source voltage during the initialization period.

The first power source voltage may have a voltage value of the level that is lower than the minimum voltage value among the voltage range of the data voltage according to the image data signal.

The second power source voltage may be determined to be the voltage value of the level that is lower than the first power source voltage or a ground potential during the light emitting period.

The second power source voltage may be maintained as the voltage value of the level that is higher than the maximum voltage value among the voltage range of the data voltage according to the image data signal during the remaining period except for the light emitting period among one frame.

A driving method of a display device according to an exemplary embodiment includes: a first step of simultaneously applying a first power source voltage having a predetermined voltage level, a second power source voltage, a scan signal, and a predetermined reference voltage transmitted to each pixel through a corresponding data line to a plurality of pixels included in a display unit to initialize a data voltage according to an image data signal of a previous frame that is respectively written to the pixel; a second step of simultaneously applying the first power source voltage having the predetermined voltage level, the second power source voltage, the scan signal, and the reference voltage transmitted through the corresponding data line to a plurality of pixels to compensate a threshold voltage of the driving transistor of the pixel; a third step of sequentially applying a scan signal for each pixel connected to each scan line of the display unit and applying the data voltage according to the image data signal through the corresponding data line to each pixel in response to the scan signal; and a fourth step of simultaneously applying the first power source voltage having the predetermined voltage level, the second power source voltage, the scan signal, and the reference voltage transmitted through the corresponding data line to a plurality of pixels to simultaneously emit a plurality of pixels according to the driving current corresponding to the data voltage applied in the third step, wherein the reference voltage is determined to be within the voltage range of the data voltage according to the image data signal.

The reference voltage may be a middle value of a maximum voltage value and a minimum voltage value among the voltage range of the data voltage.

The predetermined voltage values of the first power source voltage and the second power source voltage of the first step may be voltage values of different levels from each other.

The first power source voltage may be determined to be a voltage of the level that is lower than the second power source voltage.

The first power source voltage may be determined to be the voltage value of the level lower than the minimum voltage value among the voltage range of the data voltage.

In the second step, the first power source voltage and the second power source voltage may be determined to be voltage values of the same level, and the scan signal is applied as the voltage of the level turning on the switch included in the pixel.

In the fourth step, the first power source voltage and the second power source voltage may be determined to be voltage values of different levels, and the scan signal is applied with a voltage of the level turning off the switch included in the pixel. The second power source voltage may be determined to be the voltage of the level that is lower than the first power source voltage.

DETAILED DESCRIPTION

Figure 1:
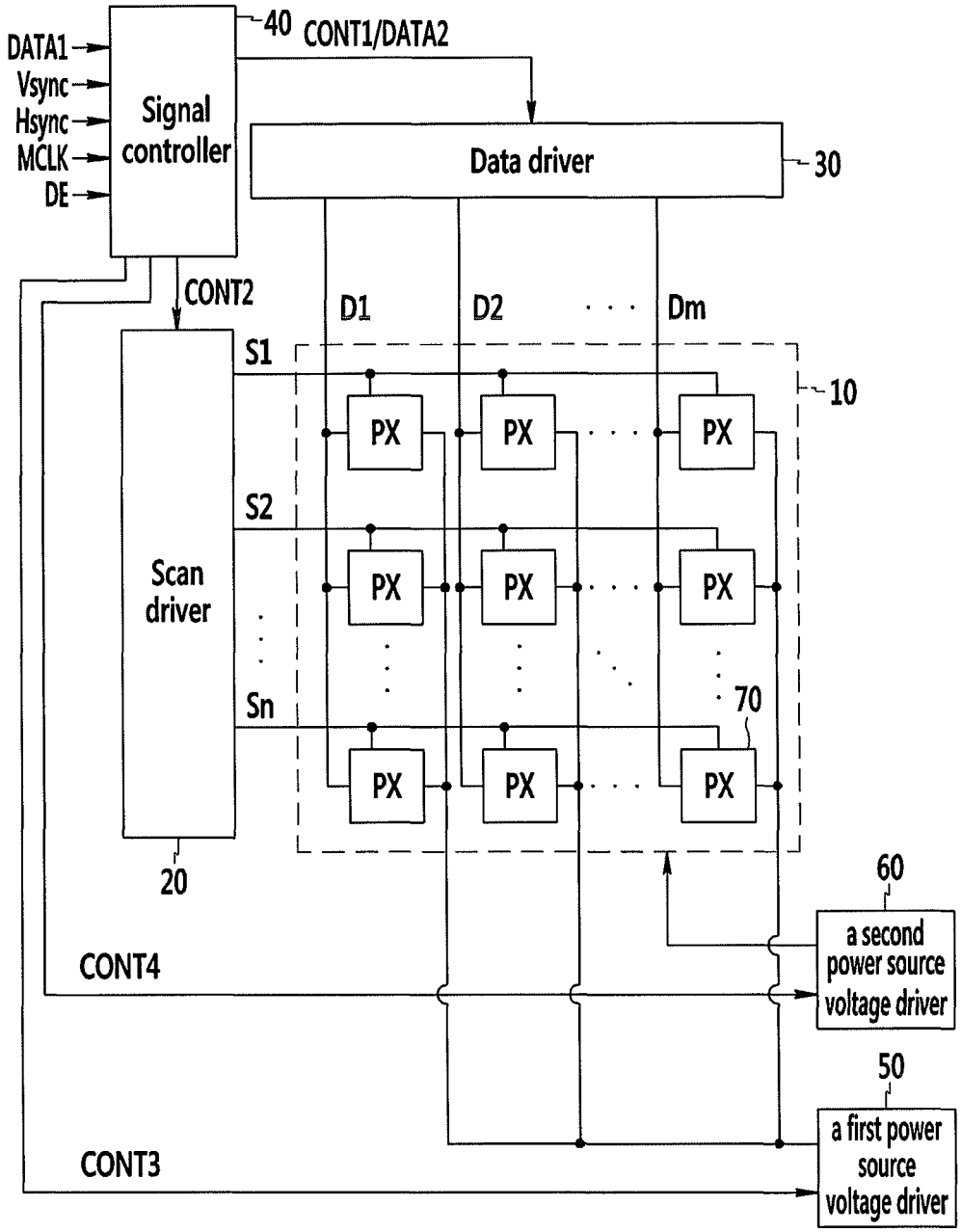
FIG. 1 is a block diagram of a display device according to an exemplary embodiment.

Example embodiments will now be described more fully hereinafter with reference to the accompanying drawings;

however, they may be embodied in different forms and should not be construed as limited to the embodiments set forth herein. Rather, these embodiments are provided so that this disclosure will be thorough and complete, and will fully convey exemplary implementations to those skilled in the art.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment. Referring to FIG. 1, a display device includes a display unit 10, a scan driver 20, a data driver 30, a signal controller 40, a first power source voltage driver 50, and a second power source voltage driver 60.

The display unit 10 according to the exemplary embodiment of FIG. 1 includes a plurality of pixels 70 provided in regions where a plurality of scan lines S1 to Sn and a plurality of data lines D1 to Dm cross each other. The plurality of pixels 70 are connected to a corresponding scan line and a corresponding data line.

The plurality of pixels 70 receive the first power source voltage ELVDD and the second power source voltage ELVSS from the first power source voltage ELVDD driver 50 and the second power source voltage ELVSS driver 60 from the outside. The first power source voltage ELVDD driver 50 and the second power source voltage ELVSS driver 60 may respectively control the first power source voltage ELVDD and the second power source voltage ELVSS to be applied to each pixel 10 of the display unit 10 with voltage values of different levels during a period of one frame. The first power source voltage ELVDD driver 50 and the second power source voltage ELVSS driver 60 may be separately formed as shown in FIG. 1, but, as another exemplary embodiment, they may be formed with one power source driver controlling and transmitting the voltage levels of the first power source voltage ELVDD and the second power source voltage ELVSS.

Operations of the first power source voltage ELVDD driver 50 and the second power source voltage ELVSS driver 60 may be controlled by the signal controller 40. In detail, during driving according to an exemplary embodiment, the signal controller 40 generates a predetermined power source driving control signal and transmits it to the first power source voltage ELVDD driver 50 and the second power source voltage ELVSS driver 60, and the first power source voltage ELVDD and the second power source voltage ELVSS are applied with the voltage value of a high level or a low level.

The scan driver 20 is connected to a plurality of scan lines S1-Sn, generates a plurality of scan signals scan(1)-scan(n), and transmits them to the corresponding scan lines according to a scan control signal CONT2. The scan control signal CONT2 controls the corresponding scan signal to be applied to a plurality of pixels included in the display unit 10 for each pixel line during a threshold voltage compensation period and a data writing period during driving of the display device.

The data driver 30 is connected to a plurality of data lines D1-Dm and transmits an image data signal DATA2 of which a video signal DATA1 transmitted from the outside according to a data driving control signal CONT1 is processed to the corresponding data line among a plurality of data lines D1-Dm. The image data signal DATA2 has a predetermined voltage range. For example, the predetermined voltage range may be 0 to 6 V.

The signal controller 40 generates a predetermined driving control signal CONT2, CONT1, CONT 3, CONT4 controlling the operation of the scan driver 20, the data driver 30, the first power source voltage ELVDD driver 50, and the second power source voltage ELVSS driver 60 of the display device and transmits them to each element respectively.

That is, the signal controller 40 generates the data driving control signal CONT1 controlling the operation of the data driver 30 and transmits it to the data driver 30, generates the scan driving control signal CONT2 controlling the operation of the scan driver 20 and transmits it to the scan driver 20, generates and transmits the first power source control signal CONT3 controlling a voltage level of the first power source voltage ELVDD supplied from the first power source voltage ELVDD driver 50, and generates and transmits the second power source control signal CONT4 controlling the voltage level of the second power source voltage ELVSS supplied from the second power source voltage ELVSS driver 60.

The data driving control signal CONT1 and the scan driving control signal CONT2 are signals controlling a sequential transmitting time of the corresponding image data signal and the corresponding scan signal that are respectively transmitted to a plurality of pixels included in the display unit. The first power source control signal CONT3 and the second power source control signal CONT4 are signals controlling a level of the voltage value according to the driving of the first power source voltage ELVDD and the second power source voltage ELVSS that are supplied to the display unit through the first power source voltage driver and the second power source voltage driver. The detailed level control of the voltage value according to the driving step of the display device will be described in following drawings.

Also, the signal controller 40 receives a video signal DATA1 input from the outside and an input control signal controlling display thereof. The video signal DATA1 include luminance information of each pixel PX, and the luminance has a predetermined number of gray levels, for example, $1024=2^{10}$, $256=2^{8}$, or $64=2^{6}$. The signal controller 40 performs an image processing process for the luminance information data included in the video signal DATA1 and transmits the compensated image data signal DATA2 to the data driver 30.

Examples of the input control signal transmitted to the signal controller 40 include a vertical synchronization signal Vsync, a horizontal synchronization signal Hsync, a main clock signal MCLK, and a data enable signal DE.

The signal controller 40 appropriately image-processes the input video signal DATA1 based on the video signal DATA1 and the input control signal that are input to be suitable for the operation condition of the display unit 10 and the data driver 30.

The video signal DATA1 is a signal that divides the external input signal by each frame unit and is processed as a video signal corresponding to the corresponding frame. The entire scan period for the display panel as the data writing period may occur for a period close to one frame (60 Hz). Therefore, the vertical synchronization signal Vsync may be transmitted every scan period close to one frame. Further, the horizontal synchronization signal Hsync may be set as a frequency required to activate all the pixels for the data writing period around the pixel line, as a frequency determined according to the data writing period which is the scan period of the one frame period. The main clock signal MCLK may be one of a clock signal having a basic frequency included in the external input signal or a clock signal generated by appropriate preprocessing.

Like the display device according to the exemplary embodiment of FIG. 1, to simplify the signal line or the voltage wire connected to a plurality of pixels included in the display unit 10, the structure of a plurality of pixels 70 must be simply improved. That is, referring to the block diagram of FIG. 1, the signal line respectively connected to a plurality of pixels basically includes the corresponding scan line and the corresponding data line, the voltage wire connected to the power source driver is simple, thereby improving the pixel structure. In general, for a large size and high resolution of the display device, the data driving method and the signal wires connected to the circuit elements of the pixel for the compensation process of the image are increased and complicated such that the driving method of the pixel is not only complicated, but the aperture ratio is also reduced as more area is occupied by wires.

The display device and the pixel included therein according to an exemplary embodiment simplifies the driving method, and the structure thereof may be improved to perform the functions and the roles according thereto.

Figure 2:
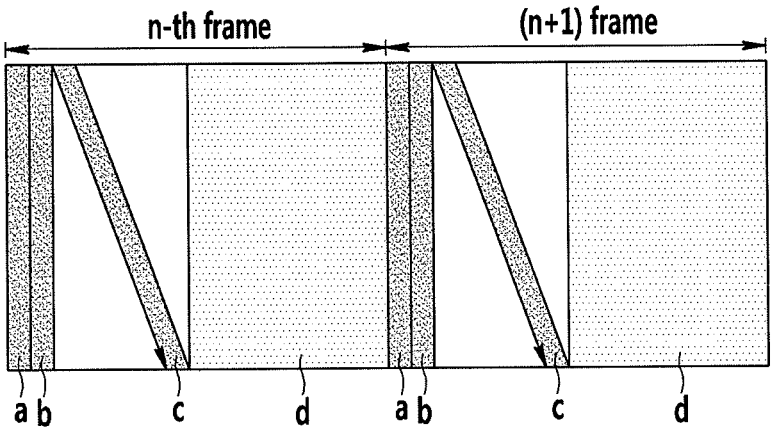
FIG. 2 is a view of a driving operation of a display device according to an exemplary embodiment.

FIG. 2 is a view to explain a driving method of a display device according to an exemplary embodiment. The display device according to an exemplary embodiment is driven with a simultaneous emission method in which the organic light emitting element of each pixel simultaneously emits light by the frame unit according to the data voltage depending on the image data signal that is sequentially written to each pixel of the display unit to display the image.

As shown in FIG. 2, according to the simultaneous light emitting method, a period of one frame includes a scan period in which a plurality of data signals are transmitted and programmed to all pixels and a light emitting period in which all pixels emit light according to the programmed data signals after the data signals are programmed to all pixels.

That is, regarding the conventional sequential light emitting method, the data signals are sequentially input to the respective scan lines and light emission is sequentially performed, and regarding the simultaneous emission drive, the data signals are sequentially input and light emission is performed as a batch after the data signals are input.

In detail, referring to FIG. 2, a driving method according to an exemplary embodiment is essentially divided into an initialization period (a) initializing the driving voltage of the organic light emitting diode (OLED) in the pixel, a threshold voltage compensation period (b) compensating a threshold voltage of the driving transistor of the organic light emitting diode (OLED), a data writing period (c) in which the scan signal is sequentially transmitted to activate a plurality of pixels of the display unit of the display device and the data signal is transmitted to the activated pixel, and a light emitting period (d) in which each organic light emitting diode (OLED) of all pixels of the display unit of the display device emits the light corresponding to the transmitted data signal.

The data writing period (c) (hereinafter, it may be referred to as a scan period) is sequentially performed for each scan line, however the initialization period (a), the threshold voltage compensation period (b), and the light emitting period (d) are simultaneously performed in the entire display unit 10.

The driving method shown in FIG. 2 represents an exemplary driving method, but embodiments are not limited thereto. For example, a light emitting off period (e) of stopping the light emitting of the entire display unit after the light emitting period (d) may be further included.

Also, according to another exemplary embodiment, an additional compensation process of the image data signal or a driving process that may be added according to the structural characteristic of the pixel may be further included between the initialization period (a) and the threshold voltage compensation period (b) and/or between the threshold voltage compensation period (b) and the data writing period (c).

The initialization period (a) initializes the driving voltage applied to the organic light emitting diode (OLED) of each pixel 70 of the display unit 10. That is, during the initialization period (a), the anode voltage of the organic light emitting diode (OLED) is decreased to a low voltage level that less than a predetermined degree. Initialization may be realized in a variety of manners and is not particularly limited to the specific example illustrated herein.

If the cathode of the organic light emitting diode (OLED) is fixed to a predetermined voltage, for example, the initialization period for setting the anode voltage of the organic light emitting diode (OLED) as the 0 V voltage. In an exemplary embodiment, to prevent the leakage current generated in the initialization period (a), the voltage of the cathode of the organic light emitting diode (OLED) may be set as a voltage higher than 0 V as the exemplary voltage.

The threshold voltage compensation period (b) compensates the threshold voltage of the driving transistor provided in each pixel 70. Although the driving transistor included in each pixel 70 of the display unit is provided in the same display unit, a threshold voltage of the driving transistors deviate from one another due to various factors, e.g., a manufacturing method, a manufacturing environment, and a material characteristic. The threshold voltage distribution of the driving transistor may result in the correct grayscales not being expressed even though the same data voltage is supplied such that the image quality is deteriorated. For this purpose, when displaying the image with the driving current according to the image data signal in each pixel, a process of compensating the threshold voltage for the deviation of the threshold voltage between the driving transistors to not be influenced by the driving current amount may be used.

Various embodiments to compensate the threshold voltage of the driving transistor may be provided, however, in an exemplary embodiment, a plurality of scan signals applied to all pixels of the display unit are simultaneously applied with a predetermined voltage level such that the deviation of the threshold voltage of the driving transistor of the pixel may be structurally compensated.

Next, during the data writing period (c), the data voltage is applied according to the image data signal through the corresponding data line after activating the pixel while the corresponding scan signal is sequentially applied to the pixel for each scan line. At this time, the scan signal transmitted to each pixel is transmitted with a predetermined voltage level. This process is sequentially performed for each scan line in the entire display unit.

Accordingly, during the light emission period (d), the organic light emitting diode (OLED) of each pixel simultaneously emits the light by corresponding to the driving current according to the data voltage that is written to each pixel and is stored with the predetermined voltage value. The organic light emitting diode (OLED) is a self-emissive element emitting the light according to a flow of the driving current.

As described above, according to an exemplary embodiment, when the driving method simultaneously emits light from all of the pixels, periods (a) to (d) are clearly divided in time, such that a number of transistors of the compensation circuit provided in each pixel 70 and the signal lines controlling it may be reduced and the circuit structure of the display device may be simplified.

Figure 3:
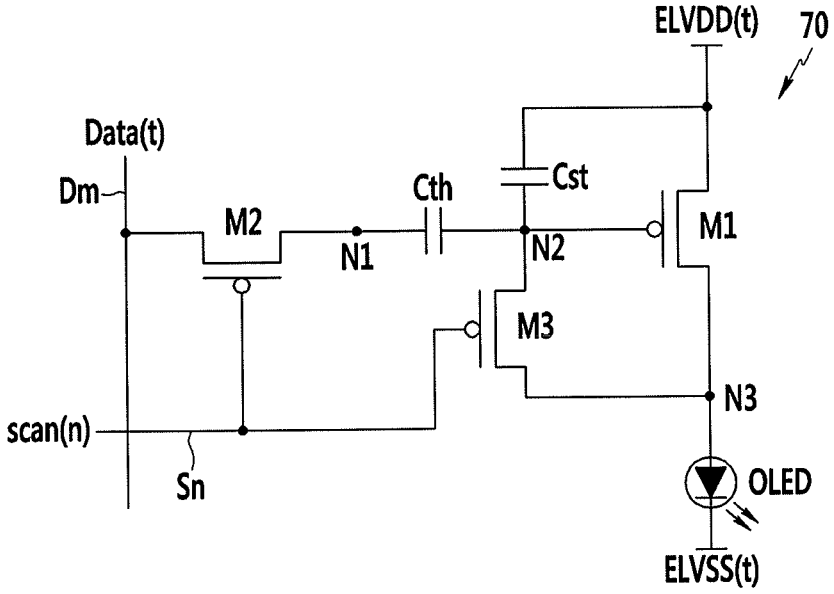
FIG. 3 is a circuit diagram of a pixel structure according to an exemplary embodiment.

FIG. 3 is a circuit diagram of a structure of a pixel 70 according to an exemplary embodiment. A driving method for the pixel of FIG. 3 will be described by using a driving timing diagram shown in FIG. 4.

The pixel 70 of FIG. 3 is a pixel 70 provided in a region where the n-th scan line Sn and the m-th data line Dm are crossed among a plurality of pixels included in the display unit 10 of the display device shown in FIG. 1. The pixel 70 includes an organic light emitting diode (OLED) and a driving circuit to supply the current to the organic light emitting diode (OLED). The driving circuit includes the first transistor M1, the second transistor M2, the third transistor M3, a storage capacitor Cst, and a compensation capacitor Cth.

As shown in FIG. 1, the pixel is connected to the first power source voltage driver 50 and the second power source voltage driver 60 through a power source wire respectively connected to the pixel. In detail, the driving circuit is connected to the first power source voltage driver 50 and the cathode of the organic light emitting diode (OLED) is connected to the second power source voltage driver 60.

The organic light emitting diode (OLED) generates the light with a predetermined luminance corresponding to the current supplied from the driving circuit. In detail, the connection of the circuit elements of the pixel included in the driving circuit is shown as follows.

The first transistor M1 includes a gate electrode connected to a second node N2, a source electrode connected to the first power source voltage ELVDD driver, and a drain electrode connected to a third node N3. The first transistor M1 transmits the driving current according to the data signal Data(t) transmitted in the data writing period Tc among one frame in the driving timing diagram of FIG. 4 to the organic light emitting diode (OLED) such that the organic light emitting diode (OLED) emits the light thereby displaying the image.

The second transistor M2 includes a gate electrode connected to the corresponding n-th scan line Sn connected to the pixel 70, a source electrode connected to the corresponding m-th data line Dm connected to the pixel 70, and a drain electrode connected to a first node N1. The second transistor M2 transmits the data voltage according to the corresponding data signal Data(t) to the first node N1 in response to the corresponding scan signal transmitted through the scan line Sn in the data writing period Tc among one frame in the driving timing diagram of FIG. 4.

The third transistor M3 includes a gate electrode connected to the corresponding n-th scan line Sn connected to the pixel 70, a first electrode connected to the third node N3, and a second electrode connected to the second node N2. In the driving timing diagram of FIG. 4, the third transistor M3 diode-connects the first transistor M1 in response to the corresponding scan signal transmitted through the scan line Sn during the threshold voltage compensation period Tb among one frame. Accordingly, the threshold voltage Vth of the first transistor is applied to the second node N2.

The storage capacitor Cst includes a first electrode connected to the second node N2 and a second electrode connected to the first power source voltage ELVDD driver. The storage capacitor Cst stores the voltage according to a voltage difference applied to the first and second electrodes during one frame of the driving timing diagram of FIG. 4, and the storage capacitor Cst is charged with the voltage corresponding to the voltage value applied to first and second electrodes in each period and maintains the voltage during a predetermined period. Particularly, the storage capacitor Cst stores the voltage according to the data signal applied to one electrode of the storage capacitor Cst during the data writing period Tc among one frame and maintains the voltage until the first transistor M1 supplies the corresponding driving current to the organic light emitting diode (OLED).

The compensation capacitor Cth includes one electrode connected to the first node N1 and the other electrode connected to the second node N2. The compensation capacitor Cth stores and maintains the voltage value according to the difference of the voltages applied to the first and second electrodes. During one frame of the driving timing diagram of FIG. 4, the voltage corresponding to the voltage value that is respectively applied to first and second electrodes is charged in each period and is maintained during the predetermined period. In particular, the corresponding voltage value is changed and maintained according to the threshold voltage Vth of the first transistor M1 applied to the second node N2 during the threshold voltage compensation period Tb.

Figure 4:
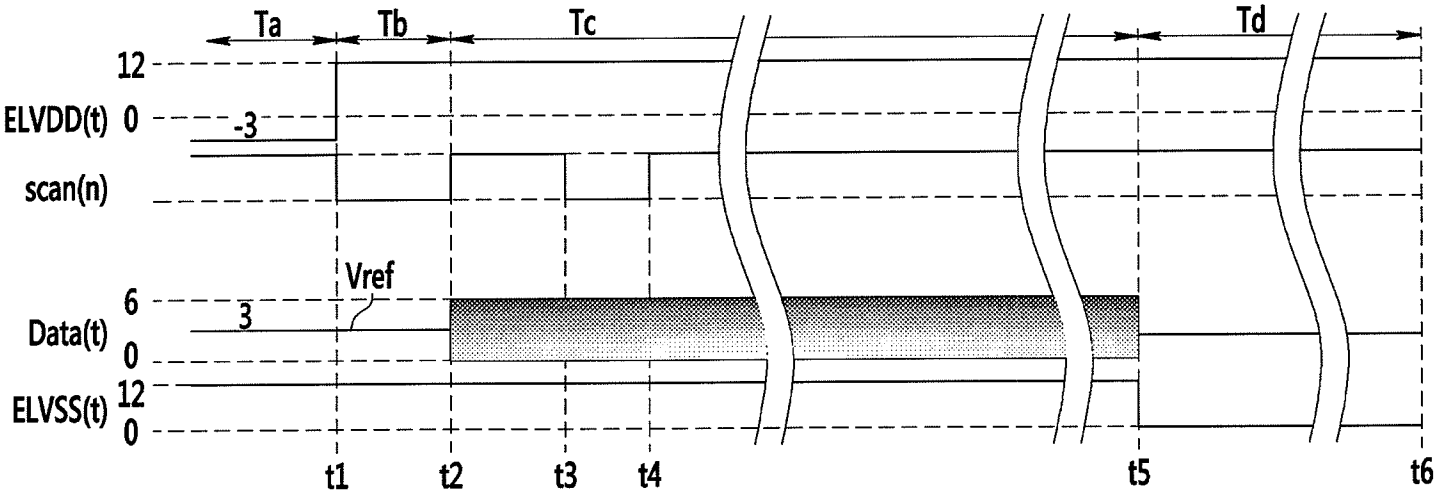
FIG. 4 is a driving timing diagram of the pixel shown in FIG. 3.

A driving process of the pixel for each driving period of one frame shown in the driving timing diagram of FIG. 4 will be described with reference to FIG. 5 to FIG. 8. As shown in FIG. 4, one frame in the driving method according to an exemplary embodiment includes the initialization period Ta, the threshold voltage compensation period Tb, the data writing period Tc, and the light emitting period Td.

Also, the driving timing diagram of FIG. 4 represents the pixel 70 shown in FIG. 3 and displays the signal applied to the pixel of FIG. 3 and the driving power source voltage level. However the voltage level of the signal and the driving power source voltage level displayed in the rest of the period except for the data writing period Tc and the voltage level control timing and the voltage level sustain period are the same in the entire pixel.

Figure 5:
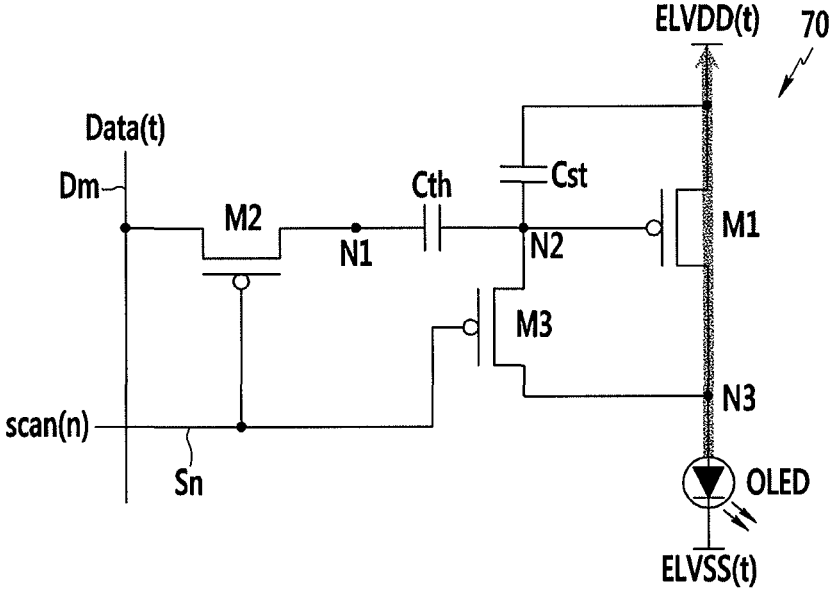
FIG. 5 to FIG. 8 are views to explain driving of a pixel according to each driving operation of FIG. 2.

Firstly, the pixel driving process during the initialization period Ta among one frame period represents the circuit diagram of FIG. 5. The first power source voltage ELVDD is applied with the voltage value that is controlled into the low voltage from the first power source voltage driver 50 to the pixel 70 through a power source wire during a period from a time that the initialization period Ta starts to a time t1. The voltage level of the low voltage is not limited, however, like the example of FIG. 4, it may be a degree of a low potential voltage value of 0 V to −3 V or a ground voltage value.

Referring to the block diagram of FIG. 1, the power source wire connected to the first power source voltage ELVDD driver 50 is connected to all pixels of the display unit 10 such that it may be confirmed that the first power source voltage ELVDD that the voltage level is controlled to during the initialization period Ta is applied to all pixels of the display unit 10.

If a potential of the first power source voltage ELVDD applied from the first power source voltage driver 50 is decreased sufficiently, e.g., to a predetermined value, the corresponding data voltage of the previous frame that is charged to the storage capacitor Cst in the previous frame is discharged. Also, the voltage of the gate electrode of the first transistor M1 is decreased such that the first transistor M1 is turned on, and the anode voltage of the organic light emitting diode (OLED) is initialized. As shown in the circuit diagram of FIG. 5, while the current path is formed from the organic light emitting diode (OLED) toward the first power source voltage ELVDD, the driving voltage in the previous frame of the organic light emitting diode (OLED) is initialized. If the data voltage corresponding to the entire pixel and applied to the previous frame is the black data voltage, the driving voltage of the organic light emitting diode (OLED) may be already maintained as the initialization voltage in the previous frame, such that the voltage level control of the first power source voltage ELVDD during the initialization period Ta may be omitted.

Next, during the time t1 to the time t2, i.e., the threshold voltage compensation period Tb, the corresponding scan signal scan(n) is transmitted to the pixel 70 with the low level voltage through the corresponding scan line Sn. The low level voltage is a gate-on voltage turning on a PMOS transistor as a transistor in the pixel 70. If the transistor in the pixel is an NMOS transistor, in the driving timing diagram of FIG. 4, the gate-on voltage level may have an opposite polarity.

In the driving timing diagram of FIG. 4, the voltage level of the n-th scan signal scan(n) transmitted to the pixel 70 through the n-th scan line among a plurality of scan signals is shown, however it is the voltage level of all scan signals transmitted to all pixels included in the display unit 10. That is, the scan signals transmitted to all pixels of the display unit during the threshold voltage compensation period Tb are applied with the low level voltage.

Figure 6:
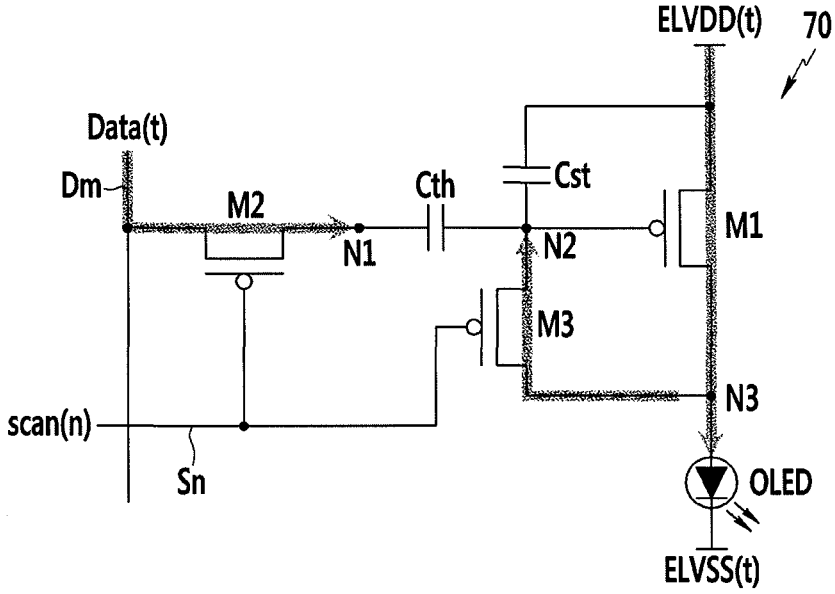

Thus, as shown in FIG. 6, the second transistor M2 and the third transistor M3 are turned on by the scan signal.

As the second transistor M2 is turned on, a predetermined reference voltage Vref is applied to the pixel 70 through the corresponding and connected data line Dm. At this time, the voltage value of the predetermined reference voltage Vref is not limited, however as shown in FIG. 4, it may be varied within the voltage range of the data signal. In the particular example herein, the voltage range of the data signal is set to be between 0 V to 6 V. Thus, the reference voltage Vref may be set within the voltage range of 0 V to 6 V, e.g., may be set as a middle value of the voltage range of the data signal. In FIG. 4, the reference voltage Vref is set as 3 V, and the reference voltage Vref may be applied to the first node N1 through the second transistor M2 that is turned on during the threshold voltage compensation period Tb. Accordingly, the voltage Va of the first node N1 during the threshold voltage compensation period Tb may be the reference voltage Vref (Va=Vref=3V).

When the third transistor M3 is turned on during the threshold voltage compensation period Tb, the gate electrode and the drain electrode of the first transistor M1 are diode-connected. Accordingly, the second node N2 and the third node N3 are connected.

Also, the voltage level of the first power source voltage ELVDD is adjusted at the time t1 that the threshold voltage compensation period Tb starts such that it is increased into the high level. In the exemplary embodiment of FIG. 4, the first power source voltage ELVDD is increased from −3 V to 12 V. In the driving process according to an exemplary embodiment, the voltage level of the first power source voltage ELVDD may be maintained with the high state during the period after the threshold voltage compensation period Tb.

Thus, by the voltage level of the first power source voltage ELVDD that is increased into the high state, as shown in FIG. 6, the current flows in a direction of the third node N3 from the supply source of the first power source voltage ELVDD, and the voltage applied to the third node N3 is transmitted to the second node N2 by the turn-on of the third transistor M3. Accordingly, the voltage Vb applied to the second node N2 during the threshold voltage compensation period Tb may be a sum of the first power source voltage ELVDD that is increased into the high level and the threshold voltage Vth of the first transistor (Vb=ELVDD+Vth).

The period from the time t2 to the time t5 is the data writing period Tc. This period is the scan period in which the corresponding scan signal is sequentially transmitted through the scan line that is sequentially connected according to a plurality of pixels included in the display unit 10.

Figure 7:
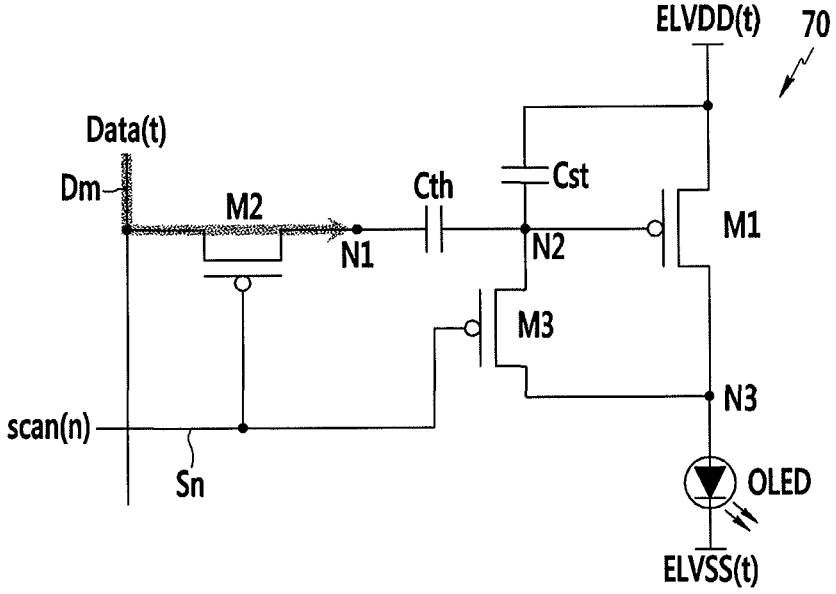

In the timing diagram of FIG. 4, only the n-th scan signal scan(n) applied to the pixel 70 connected to the n-th scan line is shown. The n-th scan signal scan(n) sent to the pixel 70 through the corresponding scan line is supplied with the low level voltage of the gate-on voltage level during the period from the time t4 to the time t5. Thus, as shown in FIG. 7, the second transistor M2 and the third transistor M3 are turned on.

The second transistor M2 that is turned on during the data writing period Tc receives the voltage Data(t) according to a predetermined data signal corresponding to the corresponding frame through the data line Dm connected to the pixel 70 and transmits it to the first node N1.

Pixels in each pixel row are activated corresponding to the scan signal that is sequentially transmitted according to the scan line corresponding to the pixel row during the data writing period Tc such that the data voltage corresponding to the data signal is respectively applied. As described above, in the exemplary embodiment of FIG. 4, as the voltage range of the data signal is 0 V to 6 V, a plurality of pixels are sequentially activated in each pixelrow and receive the voltage according to the corresponding data signal within the data voltage range.

According to the exemplary embodiment of FIG. 4, the voltage Va applied to the first node N1 during the data writing period Tc is changed from 3 V (the reference voltage) of the threshold voltage compensation period Tb into the data voltage value Vdata corresponding to each pixel. Thus, the voltage Va of the first node N1 is changed into ΔV (ΔV=3V-Vdata) through the data writing period Tc from the threshold voltage compensation period Tb such that the voltage Vb applied to the second node N2 is also changed by a coupling effect of the compensation capacitor Cth. In detail, the voltage Vb is changed into a voltage value corresponding to the second node voltage value ELVDD+Vth of the threshold voltage compensation period Tb and a ratio of the voltage value ΔV of the changed first node N1 and the capacitances of the storage capacitor Cst and the compensation capacitor Cth as follows.

$$Vb = ELVDD + Vth + \Delta V \times \frac{C2}{(C1 + C2)} \quad \text{(Equation 1)}$$

Here, C1 is the capacitance of the storage capacitor Cst, and C2 is the capacitance of the compensation capacitor Cth.

In each pixel, the storage capacitor Cst and the compensation capacitor Cth store the difference of the voltage values applied to two electrodes during a predetermined period, thereby maintaining the voltage value respectively applied to the first node N1 and the second node N2 by corresponding to each driving process during a predetermined period.

Meanwhile, after the voltage Vdata according to the corresponding data signal is applied to a plurality of pixels during the data writing period Tc, the voltage value of the second power source voltage ELVSS is controlled into the low level voltage at the time t5.

The voltage is controlled into the low level voltage value in the second power source voltage driver 60 supplying the second power source voltage ELVSS during the period from the time t5 to the time t6 and is transmitted through a power source wire connected to each pixel of the display unit 10.

The period from the time t5 to the time t6 is the light emitting period Td during which all pixels included in the display unit 10 simultaneously emit light with the driving current according to the corresponding data voltage, and the second power source voltage ELVSS maintains the high level state during the rest of the driving period except for the light emitting period Td.

The voltage value of the second power source voltage ELVSS transmitted to the low level voltage may be the ground voltage value or the voltage value of less than 0 V.

Figure 8:
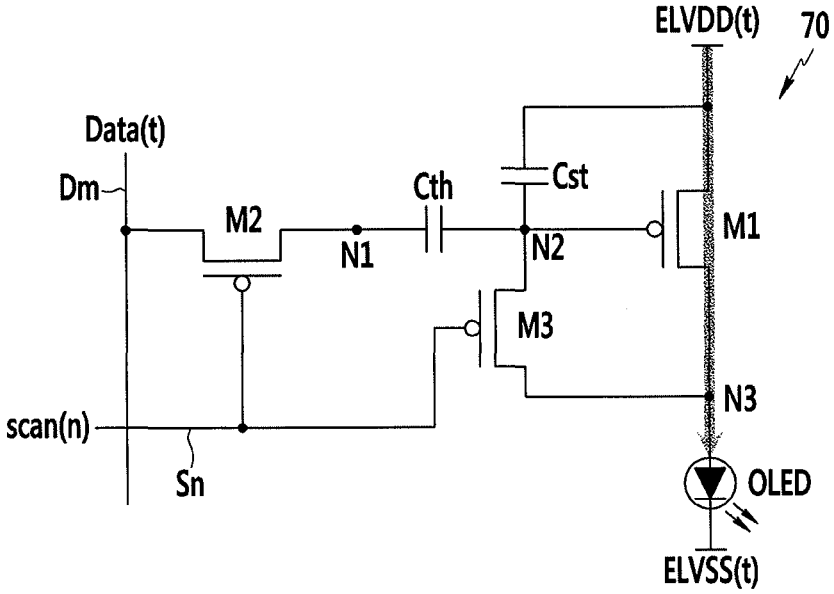

If the second power source voltage ELVSS of all pixels of the display unit 10 is simultaneously shifted into the low level voltage at the time t5, the driving current according to the voltage corresponding to the data signal that was maintained by the storage capacitor Cst and the compensation capacitor Cth flows to the organic light emitting diode (OLED) during the data writing period Tc. That is, as shown in FIG. 8, the path of the driving current corresponding to the predetermined data signal is formed from the supply source of the first power source voltage ELVDD to the supply source direction of the second power source voltage ELVSS, and the organic light emitting diode (OLED) emits the light corresponding to the driving current thereby displaying the image.

At this time, the driving current (Ioled) may be calculated as followings.

$$Ioled = k(Vgs - Vth)^2 = k(Vg - Vs - Vth)^2 \quad \text{(Equation 2)}$$

$$Ioled = k(ELVDD + Vth + \alpha - ELVDD - Vth)^2$$

$$\begin{aligned} Ioled &= k(\alpha)^2 \\ &= k\left(\Delta V \times \frac{C2}{(C1 + C2)}\right)^2 \\ &= kp(\Delta V)^2 \\ &= kp(Vref - Vdata)^2 \\ &= kp(3V - Vdata)^2 \end{aligned}$$

Here, k is a parameter determined according to a characteristic of the driving transistor of each pixel. Vgs is a voltage difference between the gate and the source of the driving transistor of each pixel, Vg is the voltage of the gate electrode of the driving transistor, and Vs is the voltage of the source electrode of the driving transistor. Also, α a indicates a voltage change amount $$\left(\Delta V \times \frac{C2}{(C1 + C2)}\right)$$

of the second node N2 by the coupling effect during the threshold voltage compensation period Tb that is reflected in Equation 1. Therefore, kp is determined to be $$k\left(\frac{C2}{(C1 + C2)}\right)^2$$

Referring to Equation 2, for the driving current Ioled corresponding to the predetermined data signal, the threshold voltage Vth of the driving transistor is removed by the equation such that the image is displayed with the driving current amount of which the deviation is compensated although the threshold voltage deviation of the driving transistor of each pixel is generated. Furthermore, the driving current amount that is finally calculated has the value of $kp(Vref-Vdata)^2$ is affected by the reference voltage Vref applied through the data line during the threshold voltage compensation period Tb and the data voltage Vdata according to the corresponding data signal.

Meanwhile, the reference voltage Vref is continuously provided to a plurality of pixels of the display unit 10 through the corresponding data line during the light emitting period Td. Accordingly, the generation of the leakage current during the light emitting period may be reduced.

In the present embodiment, the reference voltage Vref of the data is determined with the value that is varied within the voltage range of the data signal during the threshold voltage compensation period Tb. Particularly, by determining the reference voltage with the middle voltage value, e.g., 3 V, of the voltage range of the data signal, the charging time of the data voltage may be effectively reduced. Furthermore, if the reference voltage is determined with the middle voltage value of the voltage range of the data signal, the data voltage value is prevented from being changed by an IR DROP that may be generated from the large size of the display panel in the calculation of the driving current amount when displaying the image.

Accordingly, according to the pixel structure and the driving method like an exemplary embodiment, in the entire display unit of the display device, by applying the middle value of the voltage range of the data signal at the threshold voltage compensation period, the data writing speed may be quickly improved and the display quality may be improved for the light to be emitted with the luminance according to the correct image data signal.

Also, for the general and conventional display device and pixel structure, where the power wire and the control signal lines are complicated and the pixel aperture ratio is reduced, the display device and the pixel structure according to the exemplary embodiment may solve these problems through the simple constitution and the simple wire structure.

Figure 9:
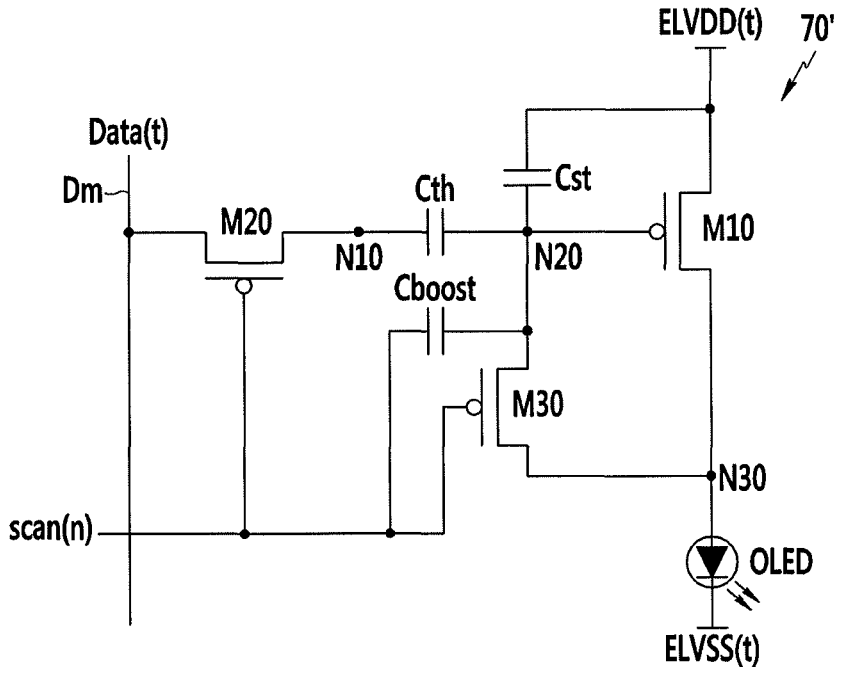
FIG. 9 is a circuit diagram of a pixel structure according to an exemplary embodiment.

FIG. 9 is a circuit diagram of a pixel 70' according to an exemplary embodiment of the present invention. Referring to FIG. 9, the present embodiment is the same as the pixel structure of the exemplary embodiment FIG. 3, however a boost capacitor Cboost is further included between the gate electrode and the second electrode of the third transistor M30.

That is, the pixel 70' of FIG. 9 includes the organic light emitting diode (OLED), a first transistor M10, a second transistor M20, a third transistor M30, a storage capacitor Cst, and a compensation capacitor Cth as the driving circuit to supply the current to the organic light emitting diode (OLED) like in the pixel of FIG. 3. However, the pixel 70' of FIG. 9 further includes the boost capacitor Cboost including a first electrode connected to the second node N20 to which the second electrode of a third transistor M30 is connected and the other electrode connected to the n-th scan line (Sn) corresponding to the pixel 70' to which the gate electrode of third transistor M30 is connected.

The driving process of the pixel of FIG. 9 is the same as the driving process of the pixel of FIG. 3 such that the description thereof is omitted. However, the pixel of FIG. 9 further includes the boost capacitor Cboost connected to the scan line transmitting the scan signal scan(n), and thereby the voltage of the gate electrode of the first transistor M10 as the driving transistor, i.e., the voltage of the second node N20, may be increased by a predetermined voltage according to the increase of the voltage level of the scan signal after the data writing period Tc is finished. The predetermined voltage value is determined according to the capacitance ratio of the capacitors Cst, Cth, and Cboost that are connected to the second node N20. In this case, when the gray voltage of the data signal transmitted through the corresponding data line Dm is increased in the low gray voltage range, the data voltage may be quickly charged by the voltage value of the second node N20 that is increased by the predetermined value when displaying a black image.

In the case of the pixel structure according to the exemplary embodiment of FIG. 9, the gray voltage of the image data signal Data(t) transmitted through the corresponding data line Dm may be controlled by considering the boosting effect of the boost capacitor Cboost.

By ways of summation and review, one or more embodiments provide a pixel suitable for a large scale display panel, high resolution, stereoscopic image display, and ensuring a sufficient aperture ratio. One or more embodiments provide a display device including a simplified pixel while ensuring a pixel aperture ratio and performance through stable light emitting driving thereby providing a display quality having clearness and reliability is provided. One or more embodiments provide a driving method of a display device sufficiently maintaining times of data writing or light emitting and stably performing each driving step thereof by sufficiently ensuring periods for performing each driving step of the display device is provided.

The drawings referred to hereinabove and the detailed description are presented for illustrative purposes only, and are not intended to define meanings or limit the scope of embodiments as set forth in the following claims. Therefore, those skilled in the art can easily select and substitute the drawings and disclosed description. Those skilled in the art can omit some of the constituent elements described in the present specification without deterioration in performance thereof or can add constituent elements to improve performance thereof. Furthermore, those skilled in the art can modify the sequence of the steps of the method described in the present specification depending on the process environment or equipment. Therefore, the scope of the present invention must be determined by the scope of the claims and the equivalents, not by the described embodiments.

<Description of Symbols>

| | |
|---|---|
| 10: display unit | 20: scan driver |
| 30: data driver | 40: signal controller |
| 50: first power source voltage driver | |
| 60: second power source voltage driver | |
| 70, 70': pixel | |

What is claimed is:

1. A display device, comprising:

a display unit including a plurality of pixels connected to corresponding scan lines among a plurality of scan lines and corresponding data lines among a plurality of data lines;

a scan driver sequentially generating and transmitting scan signals respectively corresponding to the pixels and the plurality of scan lines;

a data driver generating and transmitting data voltages according to corresponding image data signals to the plurality of data lines during one frame;

a first power source voltage driver respectively applying voltages of a first power source to the pixels;

a second power source voltage driver respectively applying a second power source voltage to the pixels; and a signal controller controlling operation of the scan driver, the data driver, the first power source voltage driver, and the second power source voltage driver, wherein:

a predetermined reference voltage is transmitted through the plurality of data lines during a threshold voltage compensation period of one frame, the predetermined reference voltage corresponding to an intermediate value that is substantially halfway between a maximum voltage value and a minimum voltage value of a voltage range of the data voltages, the first power source voltage driver applies a first predetermined voltage to the pixels during an initialization period and applies a second predetermined voltage to the pixels during the threshold voltage compensation period, and the first power source voltage driver applies the first predetermined voltage in a range of 0V to −3V during the initialization period, the range of 0V to −3V lower than a voltage level of the second power source voltage output from the second power source voltage driver during the initialization period, the initialization period to initialize data voltages according to image data signals of a previous frame written to the pixels.

2. The display device of claim 1, wherein one frame includes:

the threshold voltage compensation period for compensating a threshold voltage of a driving transistor of the pixel, a period in which the scan signal is sequentially transmitted to the pixels and the data voltages according to the image data signals are transmitted, and a period in which a plurality of pixels simultaneously emit light according to driving currents corresponding to the data voltages according to the image data signals respectively transmitted to the pixels, wherein the predetermined reference voltage is applied in the initialization period, the threshold voltage compensation period, and the emitting period.

3. The display device of claim 1, wherein the first power source voltage driver and the second power source voltage driver apply the first predetermined voltage of the first power source voltage and the second power source voltage with different levels from each other during the initialization period for initializing the data voltages according to the image data signals of the previous frame that is respectively written to the pixels among one frame and the light emitting period in which the pixels simultaneously emit the light according to the driving currents corresponding to the data voltages according to the image data signals respectively transmitted to the pixels.

4. The display device of claim 1, wherein the first predetermined voltage of the first power source voltage is lower than the minimum voltage value of the voltage range of the data voltage.

5. The display device of claim 1, wherein the second power source voltage driver applies the second power source voltage lower than the voltage level of the first power source voltage or a ground potential during the light emitting period for simultaneously light-emitting according to the driving currents corresponding to the data voltages of the image data signals that is respectively written to the pixels among the one frame.

6. The display device of claim 5, wherein the second power source voltage is higher than the maximum voltage value of the voltage range of the data voltage period other than the light-emitting period.

7. The display device of claim 1, wherein the first power source voltage and the second power source voltage are simultaneously provided to the plurality of pixels.

8. The display device of claim 1, wherein the scan driver simultaneously applies the scan signal corresponding to each pixel to the plurality of scan lines during a predetermined period among one frame and simultaneously applies the corresponding scan signal for a plurality of scan lines during the remaining period except for a predetermined period.

9. The display device of claim 8, wherein the voltage level of the scan signal that is simultaneously applied to the plurality of scan lines is a voltage level turning on a switch in each pixel during a period for compensating a threshold voltage of a driving transistor in each pixel among the remaining period except for the predetermined period.

10. A pixel, comprising:

an organic light emitting diode (OLED) displaying an image by emitting light according to a driving current corresponding to a data voltage according to an image data signal;

a switching transistor transmitting the data voltage applied through a data line to a first node in response to a scan signal applied through a scan line;

a first capacitor including a first electrode connected to the first node and a second electrode connected to a second node;

a second capacitor including a first electrode connected to the second node and a second electrode connected to a first power source voltage supply source;

a driving transistor including a gate electrode connected to the second node, a source electrode connected to a first power source voltage supply source, and a drain electrode connected to a third node and supplying a driving current corresponding to the data voltage to the organic light emitting diode (OLED); and a compensation transistor including a gate electrode connected to the scan line, a source electrode connected to the third node, and a drain electrode connected to the second node and diode-connecting the gate electrode and the drain electrode of the driving transistor in response to the scan signal applied through the scan line, wherein the first capacitor is connected in series with the switching transistor and wherein the first capacitor is to store a voltage to perform threshold compensation of the driving transistor.

11. The pixel of claim 10, wherein the pixel further includes a boost capacitor including a first electrode connected to the second node and a second electrode connected to the scan line.

12. The pixel of claim 11, wherein the boost capacitor changes the voltage value of the second node in response to the scan signal applied through the scan line.

13. The pixel of claim 10, wherein a predetermined reference voltage is applied through the data line during a remaining period of the one frame other than a period in which the switching transistor transmits the data voltage according to the image data signal.

14. The pixel of claim 13, wherein the predetermined reference voltage is within a voltage range of the data voltage according to the image data signal.

15. The pixel of claim 13, wherein the predetermined reference voltage is an intermediate middle voltage value substantially halfway between of a maximum voltage value and a minimum voltage value of a voltage range of the data voltage according to the image data signal.

16. The pixel of claim 10, wherein:

during an initialization period for initializing the data voltage according to an image data signal of a previous frame that is written to the pixel and a light emitting period in which the organic light emitting diode (OLED) emits light according to a driving current corresponding to the data voltage according to the image data signal transmitted to the pixel, and the first power source voltage applied from the first power source voltage supply source and a second power source voltage applied to a cathode of the organic light emitting diode (OLED) are different from each other.

17. The pixel of claim 16, wherein the first power source voltage is lower than the second power source voltage during the initialization period.

18. The pixel of claim 17, wherein the first power source voltage has a voltage that is lower than a minimum voltage value among a voltage range of the data voltage according to the image data signal.

19. The pixel of claim 16, wherein the second power source voltage is lower than the first power source voltage or a ground potential during the light emitting period.

20. The pixel of claim 19, wherein the second power source voltage is maintained as the voltage value higher than the maximum voltage value among the voltage range of the data voltage according to the image data signal during a remaining period in the one frame other than a light emitting period.

21. A method driving a display device, comprising:

initializing data voltages according to image data signals of a previous frame that are respectively written to a plurality of pixels, the initializing including simultaneously applying a first power source voltage having a first predetermined voltage level, a second power source voltage, and a predetermined reference voltage to each of the pixels, the predetermined reference voltage transmitted to each of the pixels through a corresponding data line;

compensating a threshold voltage of a driving transistor of each of the pixels, the compensating including simultaneously applying the first power source voltage having a second predetermined voltage level, the second power source voltage, a scan signal, and the predetermined reference voltage transmitted through the corresponding data line;

sequentially applying a scan signal for each of the pixels connected to respective scan lines of the display device and applying data voltages according to image data signals through corresponding data lines to respective ones of the pixels in response to the scan signal; and simultaneously emitting light from the pixels according to the driving currents corresponding to the data voltages sequentially applied by simultaneously applying the first power source voltage having the second predetermined voltage level, the second power source voltage, and the reference voltage transmitted through the corresponding data line to a plurality of pixels, wherein the reference voltage corresponds to an intermediate value that is substantially halfway between a maximum voltage value and a minimum voltage value within a voltage range of the data voltages according to the image data signal, wherein the first predetermined voltage level is applied in a range of 0V to −3V during initializing the data voltages, the range of 0V to −3V lower than a voltage level of the second power source voltage during the initialization period.

22. The method of claim 21, wherein the first power source voltage is substantially equal to the second power source voltage during applying of the scan signal.

23. The method of claim 22, wherein the first predetermined voltage level of the first power source voltage is lower than the second power source voltage during initializing.

24. The method of claim 22, wherein the first predetermined voltage level first power source voltage is lower than a minimum voltage value of the voltage range of the data voltage.

25. The method of claim 21, wherein, during compensating, the second predetermined voltage level of the first power source voltage and the second power source voltage are the same and the scan signal is a voltage to turn on a switch in each of the pixels.

26. The method of claim 21, wherein, during simultaneously emitting, the first power source voltage and the second power source voltage are different, and the scan signal supplies a voltage of the level turning off the switch in the pixel.

27. The method of claim 26, wherein the second power source voltage is lower than the first power source voltage during simultaneous emitting.

28. The method of claim 21, wherein the second power source voltage is higher than a maximum voltage value of the voltage range of the data voltage during a time other than the simultaneously emitting.

29. The pixel of claim 10, wherein the second node between the first capacitor and the driving transistor.

30. The display device of claim 1, wherein:

the predetermined reference voltage is applied to a first node of a compensation capacitor in each of the pixels, and a voltage based on the second predetermined voltage level of the first power source voltage is applied to a second node of the compensation capacitor during the threshold voltage compensation period.

31. The method of claim 21, wherein:

the predetermined reference voltage is applied to a first node of a compensation capacitor in each of the pixels, and a voltage based on the second predetermined voltage level of the first power source voltage is applied to a second node of the compensation capacitor.

* * * * *